US009429901B2

(12) United States Patent
Okabe

(10) Patent No.: US 9,429,901 B2
(45) **Date of Patent: *Aug. 30, 2016**

(54) PHOTOSENSITIVE DRUM ACCESS CONFIGURATION FOR AN IMAGE-FORMING APPARATUS

(71) Applicant: Brother Kogyo Kabushiki Kaisha, Nagoya-shi, Aichi-ken (JP)

(72) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/867,252

(22) Filed: Sep. 28, 2015

(65) Prior Publication Data

US 2016/0018782 A1 Jan. 21, 2016

Related U.S. Application Data

(63) Continuation of application No. 13/626,216, filed on Sep. 25, 2012, now Pat. No. 9,146,528.

(30) Foreign Application Priority Data

Dec. 26, 2011 (JP) ..... 2011-284469

(51) Int. Cl.
*G03G 15/08* (2006.01)
*G03G 21/16* (2006.01)

(52) U.S. Cl.
CPC ..... *G03G 21/1666* (2013.01); *G03G 21/1633* (2013.01); *G03G 21/1676* (2013.01); *G03G 2215/0141* (2013.01)

(58) Field of Classification Search
CPC ..... G03G 21/1633; G03G 21/1666; G03G 2215/0141
See application file for complete search history.

(56) References Cited

U.S. PATENT DOCUMENTS 8,583,004 B2 11/2013 Kamimura
8,744,321 B2 6/2014 Kubota et al.

(Continued)

FOREIGN PATENT DOCUMENTS

JP 2007-065125 A 3/2007
JP 2011070142 A 4/2011

(Continued)

OTHER PUBLICATIONS

Nov. 10, 2015—(JP) Notice of Reasons for Rejection—App 2011-284469.

*Primary Examiner* — G. M. Hyder
(74) *Attorney, Agent, or Firm* — Banner & Witcoff, Ltd.

(57) ABSTRACT

An image forming apparatus includes a main body, a photosensitive drum detachably attached to the main body, a light exposure member configured to expose the photosensitive member to light, a developer container configured to store a developer to be supplied to the photosensitive drum, and a supporting member disposed in the main body and configured to support the light exposure member and to hold the developer container detachably. The supporting member is configured to, while holding the developer container, move between a light exposure position where the light exposure member is located proximate to the photosensitive drum and a separation position where the light exposure member is separated from the photosensitive drum while the supporting member holds the developer container.

8 Claims, 12 Drawing Sheets

(56) References Cited

U.S. PATENT DOCUMENTS

| | | | |
|---|---|---|---|
| 8,792,808 | B2 | 7/2014 | Kubota et al. |
| 2006/0153589 | A1 | 7/2006 | Sato et al. |
| 2008/0219696 | A1 | 9/2008 | Itabashi |
| 2009/0052938 | A1 | 2/2009 | Sameshima et al. |
| 2009/0169245 | A1 | 7/2009 | Sato |
| 2009/0190953 | A1 | 7/2009 | Okabe |
| 2012/0099886 | A1 | 4/2012 | Kim |
| 2012/0114373 | A1 | 5/2012 | Hamada et al. |
| 2012/0163857 | A1 | 6/2012 | Kamimura |
| 2012/0183323 | A1 | 7/2012 | Nakano et al. |
| 2012/0183325 | A1 | 7/2012 | Sato et al. |
| 2012/0328329 | A1 | 12/2012 | Sato et al. |
| 2014/0294449 | A1 | 10/2014 | Kubota et al. |

FOREIGN PATENT DOCUMENTS

| | | | |
|---|---|---|---|
| JP | 2011-175258 | A | 9/2011 |
| WO | 2011024491 | A1 | 3/2011 |
| WO | 2013015455 | A1 | 1/2013 |

PHOTOSENSITIVE DRUM ACCESS CONFIGURATION FOR AN IMAGE-FORMING APPARATUS

CROSS REFERENCE TO RELATED APPLICATION

This application is a continuation of U.S. patent application Ser. No. 13/626,216 filed Sep. 25, 2012, which claims priority from Japanese Patent Application No. 2011-284469, filed on Dec. 26, 2011, the entire subject matter of which is incorporated herein by reference.

FIELD

Aspects of the disclosure relate to an electrophotographic image forming apparatus.

BACKGROUND

A known electrophotographic image forming apparatus includes a main body having an opening, an LED head, and a photosensitive member unit integrally including a photosensitive drum and a toner cartridge. The photosensitive member unit is configured to be detachably attachable to the main body through the opening. The LED head is configured to expose the photosensitive drum.

The main body includes a top cover to open and close the opening. The LED head is held on an inner surface of the top cover.

When the top cover is in a closed position to close the opening, the LED head is brought close to the photosensitive drum. When the top cover is in an open position to release the opening, the LED head is separated from the photosensitive drum.

Before the photosensitive member unit is attached to or removed from the main body, the top cover is located in the open position so that the LED head is separated from the photosensitive drum.

SUMMARY

In terms of maintenance and running cost reduction, it is to be desired that the toner cartridge and the photosensitive drum are separately provided.

However, if the toner cartridge and the photosensitive drum are separately provided in the above image forming apparatus, the photosensitive drum should be removed from the main body after the LED head is separated from the photosensitive drum and the toner cartridge is removed from the main body.

In other words, even if only the photosensitive drum is replaced, it is necessary to remove the toner cartridge from the main body, which makes it complicated to replace the photosensitive drum.

Illustrative aspects of the disclosure provide an image forming apparatus including a developer storing container and a photosensitive drum, which are provided separately, and being configured to improve maintenance of the photosensitive drum.

According to an aspect of the disclosure, an image forming apparatus includes a main body, a photosensitive drum detachably attached to the main body, a light exposure member configured to expose the photosensitive member to light, a developer container configured to store a developer to be supplied to the photosensitive drum, and a supporting member disposed in the main body and configured to support the light exposure member and to hold the developer container detachably. The supporting member is configured to, while holding the developer container, move between a light exposure position where the light exposure member is located proximate to the photosensitive drum and a separation position where the light exposure member is separated from the photosensitive drum while the supporting member holds the developer container.

According to another aspect of the disclosure, an image forming apparatus includes a main body, a plurality of photosensitive drums detachably attached to the main body, a plurality of light exposure members configured to expose the plurality of photosensitive members to light respectively, a plurality of developer containers each configured to store a developer to be supplied to a corresponding one of the plurality of photosensitive drums, and a supporting member disposed in the main body and configured to support the plurality of light exposure members and to hold the plurality of developer containers detachably. The supporting member is configured to, while holding the plurality of developer containers, move between a light exposure position where each of the plurality of light exposure members is located proximate to a corresponding one of the plurality of photosensitive drums and a separation position where the each of the plurality of light exposure members is separated from the corresponding one of the plurality of photosensitive drums.

According to another yet aspect of the disclosure, an image forming apparatus includes a first unit including a photosensitive drum detachably, and a second unit including a light exposure member configured to expose the photosensitive member to light and a developer container configured to store a developer to be supplied to the photosensitive drum. The second unit is configured to move relative to the first unit between a light exposure position where the light exposure member is located approximate to the photosensitive drum and a separation position where the light exposure member is separated from the photosensitive drum.

BRIEF DESCRIPTION OF THE DRAWINGS

Illustrative aspects will be described in detail with reference to the following figures in which like elements are labeled with like numbers and in which.

DETAILED DESCRIPTION

A first illustrative embodiment will be described in detail with reference to the accompanying drawings.

Figure 1:
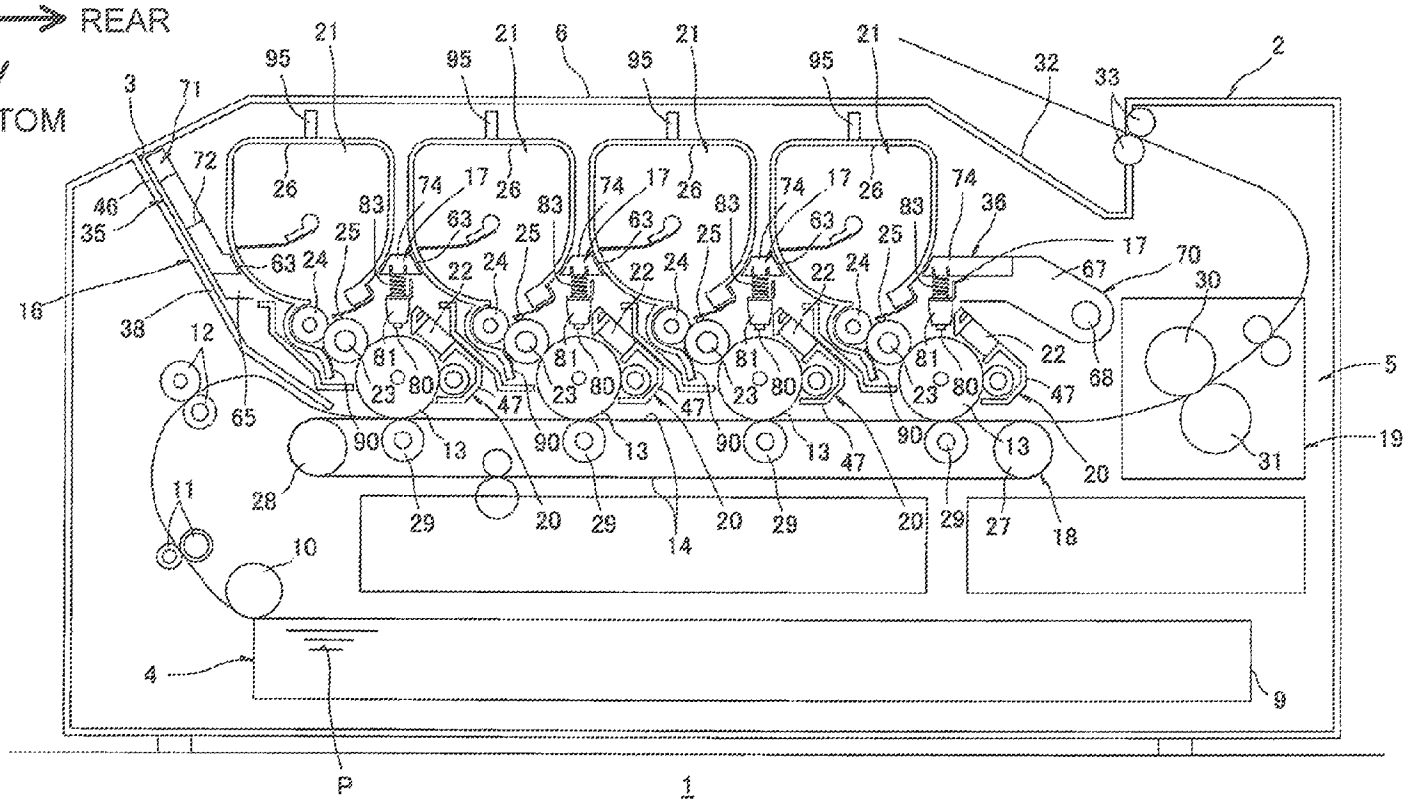
FIG. 1 is a side sectional view of an illustrative image forming apparatus, e.g. a printer, according to a first embodiment.

As shown in FIG. 1, an image forming apparatus according to aspects of the invention applies to a printer 1, which is a direct tandem type color printer.

For ease of discussion, in the following description, the top or upper side, the bottom or lower side, the left or left side, the right or right side, the front or front side, and the rear or rear side are used to define the various parts when the laser printer 1 is disposed in an orientation in which it is intended to be used. In FIG. 1, the left side is referred to as the front or front side, the right side is referred to as the rear or the rear side, the up side is referred to as the top or upper side, and the down side is referred to as the bottom or lower side.

The printer 1 includes a casing 2 as an example of a main body, a sheet supply section 4 configured to supply a sheet P, and an image forming section 5 configured to form an image on the sheet P supplied from the sheet supply section 4.

The casing 2 is box-shaped and accommodates the sheet supply section 4 and the image forming section 5 therein. An upper end portion of the casing 2 contains an opening 3.

The upper end portion of the casing 2 also contains a top cover 6, as an example of open-and-close member, which is configured to open and close the opening 3.

Figure 2:
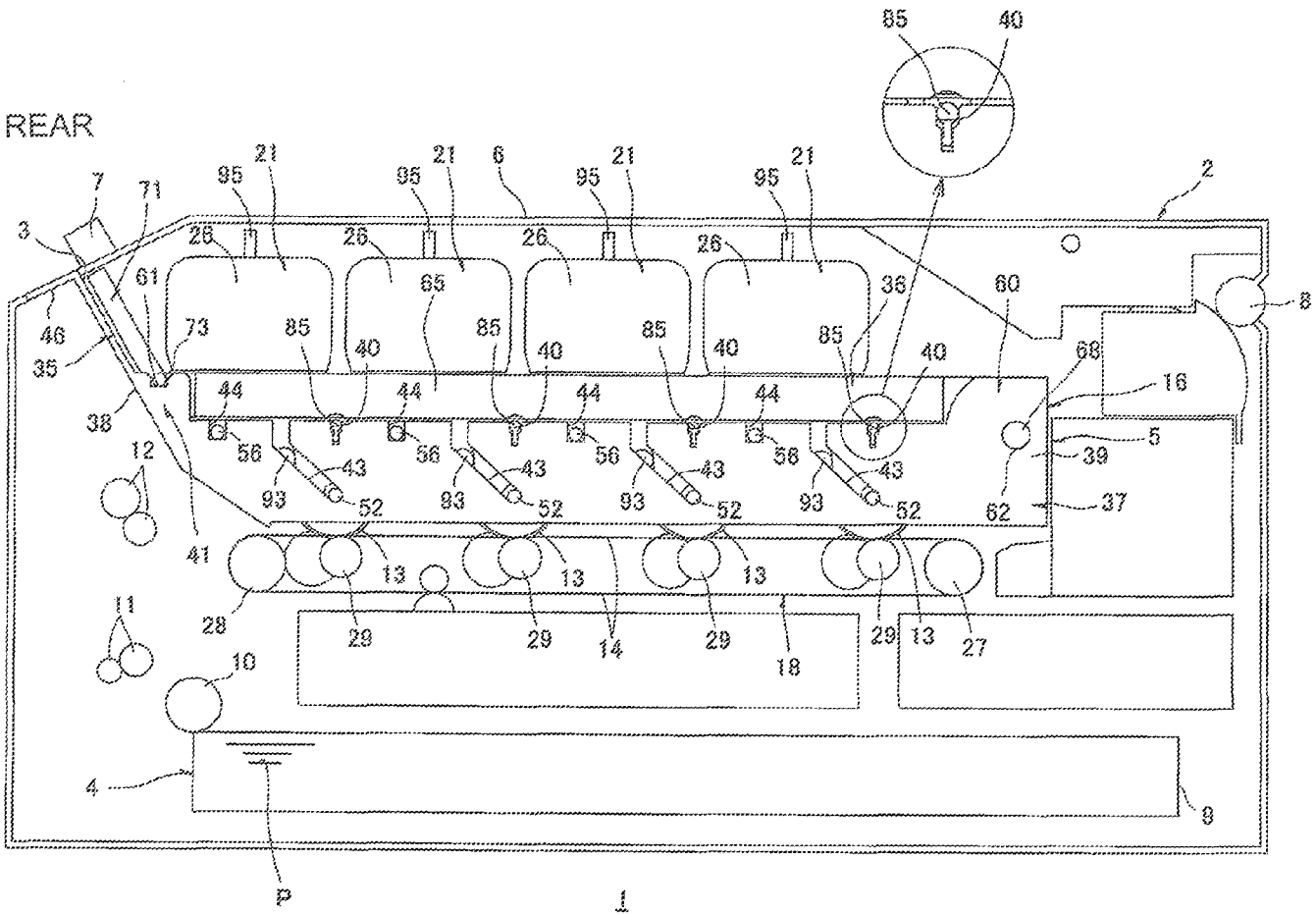
FIG. 2 is a right side view of the printer shown in FIG. 1, from which a right side wall of a casing is omitted.

As shown in FIG. 2, the top cover 6 is shaped like a flat plate, and includes a handle 7 at its front end portion and a hinge portion 8 at its rear end portion.

Figure 7:
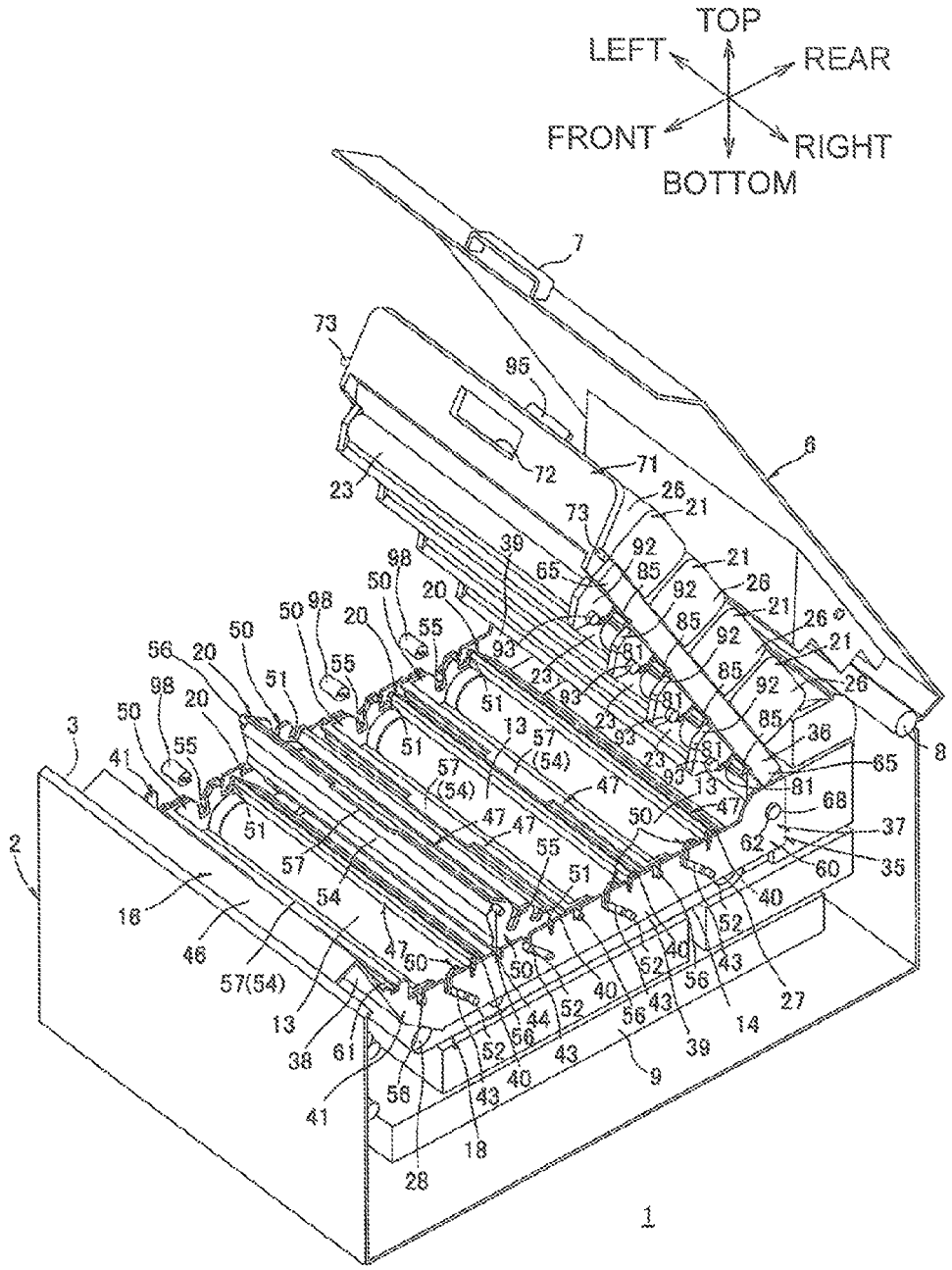
FIG. 7 is a perspective view of the printer shown in FIG. 1, in which a developing cartridge holding frame is located in an upper position.

As shown in FIG. 7, the handle 7 is shaped like a letter U, and fixed to the top cover 6 such that it is located in a central portion of a front end of an upper surface of the top cover 6.

The top cover 6 is configured to pivot on the hinge portion 8 between an open position (FIG. 4) to open the opening 3 and a closed position (FIG. 2) to close the opening 3.

As shown in FIG. 1, the sheet supply section 4 includes a sheet supply tray 9 configured to store stack of sheets P therein. The sheet supply tray 9 is disposed in a lower portion of the casing 2 and non-destructively detachable from and attachable to the casing 2.

The sheet supply section 4 further includes a pickup roller 10, sheet supply rollers 11, and registration rollers 12. The sheets P in the sheet supply tray 9 are fed by rotation of the pickup roller 10, and separated one by one by rotation of the sheet supply rollers 11. By rotation of the sheet supply roller 11, a separated sheet P passes to between the registration rollers 12. By rotation of the registration rollers 12, the sheet P is supplied to the image forming section 5 (specifically, between photosensitive drums 13 and a conveyor belt 14) at a specified time.

The image forming section 5 includes a process unit 16, a plurality of light emitting diode (LED) units 17 as an example of an exposure member, a transfer unit 18, and a fixing unit 19.

The process unit 16 is disposed in an upper portion of the casing 2, and includes a plurality of drum cartridges 20 and a plurality of developing cartridges 21 as an example of a developer container.

There are four drum cartridges 20, which are prepared for respective colors of black, yellow, magenta, and cyan, and spaced apart from each other in the front-rear direction.

Each of the drum cartridges 20 includes a photosensitive drum 13 and a scorotron charger 22. In other words, there are four photosensitive drums 13 prepared for colors of black, yellow, magenta, and cyan, respectively.

Each of the photosensitive drums 13 has substantially a cylindrical shape, which is elongated in the left-right direction (FIG. 7). The photosensitive drums 13 are rotatably supported in the respective drum cartridges 20.

Each of the scorotron chargers 22 is disposed at a small distance above and behind a corresponding one of the photosensitive drums 13.

There are four developing cartridges 21, each disposed opposite to a corresponding one of the photosensitive drums 13 at an upper front side thereof. The developing cartridges 21 include respective developing rollers 23.

Each of the developing rollers 23 is rotatably supported in a lower end of a corresponding one of the developing cartridges 21 such that the developing roller 23 is exposed from below and rear and a corresponding photosensitive drum 13 contacts the developing roller 23 from the rear side.

Each developing cartridge 21 includes a supply roller 24 configured to supply toner to the developing roller 23, a layer-thickness regulating blade 25 configured to regulate a thickness of toner supplied to the developing roller 23, and a toner storing portion 26 disposed above the supply roller 24 and the layer-thickness regulating blade 25. Each toner storing portion 26 contains a developer, e.g. toner of each color.

There are four LED units 17 disposed facing the respective photosensitive drums 13 from above. Each LED unit 17 is configured to expose a surface of its corresponding photosensitive drum 13 based on image data and form a latent image on the surface.

The transfer unit 18 is disposed above the sheet supply section 4 and under the process unit 16 and arranged along the front-rear direction.

The transfer unit 18 includes a drive roller 27, a driven roller 28, a conveyor belt 14, and a plurality of, e.g., four, transfer rollers 29.

The drive roller 27 and the driven roller 28 are spaced apart from each other and disposed facing each other in the front-rear direction.

The conveyor belt 14 is looped around the drive roller 27 and the driven roller 28 and disposed such that an upper side of the conveyor belt 14 contacts the photosensitive drums 13.

The conveyor belt 14 is configured to rotate upon rotation of the drive roller 27 in such a direction that the upper side contacting the photosensitive drums 13 moves from the front side to the rear side.

The transfer rollers 29 are disposed within the conveyor belt 14 and opposite to the respective photosensitive drums 13 in the top-bottom direction such that the lower side of the conveyor belt 14 is sandwiched between the transfer rollers 29 and the respective photosensitive drums 13.

The fixing unit 19 is disposed at the rear of the transfer unit 18 and includes a heat roller 30 and a pressure roller 31 disposed facing the heat roller 30.

In each developing cartridge 21, toner in the toner storing portion 26 is supplied to the supply roller 24 and then supplied from the supply roller 24 to the developing roller 23. Toner supplied to the developing roller 23 is positively charged between the supply roller 24 and the developing roller 23 by friction with rotation of the developing roller 23, regulated to a specified thickness by the layer-thickness regulating blade 25 and then carried on a surface of the developing roller 23 as a thin layer having a specified thickness.

The surface of the photosensitive drum 13 is uniformly charged by the scorotron charger 22 along with rotation of the photosensitive drum 13, and then exposed by the LED unit 17. Thus, an electrostatic latent image corresponding to an image to be formed on a sheet P is formed on the surface of the photosensitive drum 13.

When the photosensitive drum 13 further rotates, the toner carried on the surface of the developing roller 23 is supplied to the electrostatic latent image formed on the surface of the photosensitive drum 13. With this, the electrostatic latent image on the photosensitive drum 13 is visualized, and a toner image is carried on the surface of the photosensitive drum 13 by reversal developing. In this manner, toner images are carried on the surfaces of the respective photosensitive drums 13.

The sheet P supplied from the sheet supply section 4 is conveyed from the front side to the rear side by the conveyor belt 14. When the sheet P passes through a transfer position between each of the photo sensitive drums 13 and a corresponding one of the transfer rollers 29, the toner images carried on the surfaces of the respective photosensitive drums 13 are sequentially transferred onto the sheet P and a color image is formed on the sheet P.

The color image transferred onto the sheet P in the transfer unit 18 is thermally fixed onto the sheet P through the application of heat and pressure while the sheet P passes between the heat roller 37 and the pressure roller 38.

Then, the sheet P is conveyed such that it is u-turned toward an upper front side, and ejected to an ejection tray 32 disposed on the top cover 6.

The process unit 16 will be described.

As shown in FIG. 2, the process unit 16 includes a process frame 35.

The process frame 35 includes a developing cartridge holding frame 36, as an example of a supporting member, and a drum cartridge holding frame 37. The developing cartridge holding frame 36 is configured to hold the developing cartridges 21 detachably. The drum holding frame 37 is configured to hold the drum cartridge 20 detachably.

As shown in FIG. 7, the drum cartridge holding frame 37 is shaped in substantially a rectangle as viewed from the top, and includes a pair of left and right sidewalls 39, which are disposed apart from each other in the left-right direction, and a front wall 38 extending between front end portions of the side walls 39.

As shown in FIG. 2, each sidewall 39 is shaped in substantially a rectangle elongated in the front-rear direction, and a front end portion of each sidewall 39 is inclined diagonally upward toward the front side.

Each sidewall 39 has a plurality of, e.g., four, drum positioning grooves 44, drum guide grooves 43, and LED positioning grooves 40.

The drum positioning grooves 44 are spaced in the front-rear direction such that each of the drum positioning grooves 44 corresponds to one of upper bosses 56 of the drum cartridges 20.

Each of the drum positioning grooves 44 is shaped like a letter U, in a side view, which is recessed downward from an upper end of the sidewall 39. Each drum positioning groove 44 has a width substantially equal to an outside diameter of the upper boss 56.

Each of the drum guide grooves 43 is disposed at the rear of a corresponding one of the drum positioning grooves 44 such that each of the drum guide grooves 43 corresponds to one of lower bosses 52 of the drum cartridges 20.

Each of the drum guide grooves 43 formed in the right sidewall 39 extends downward from the upper end of the right sidewall 39 at an upper portion thereof and is inclined rearward toward the bottom side at a lower portion thereof.

Figure 3:
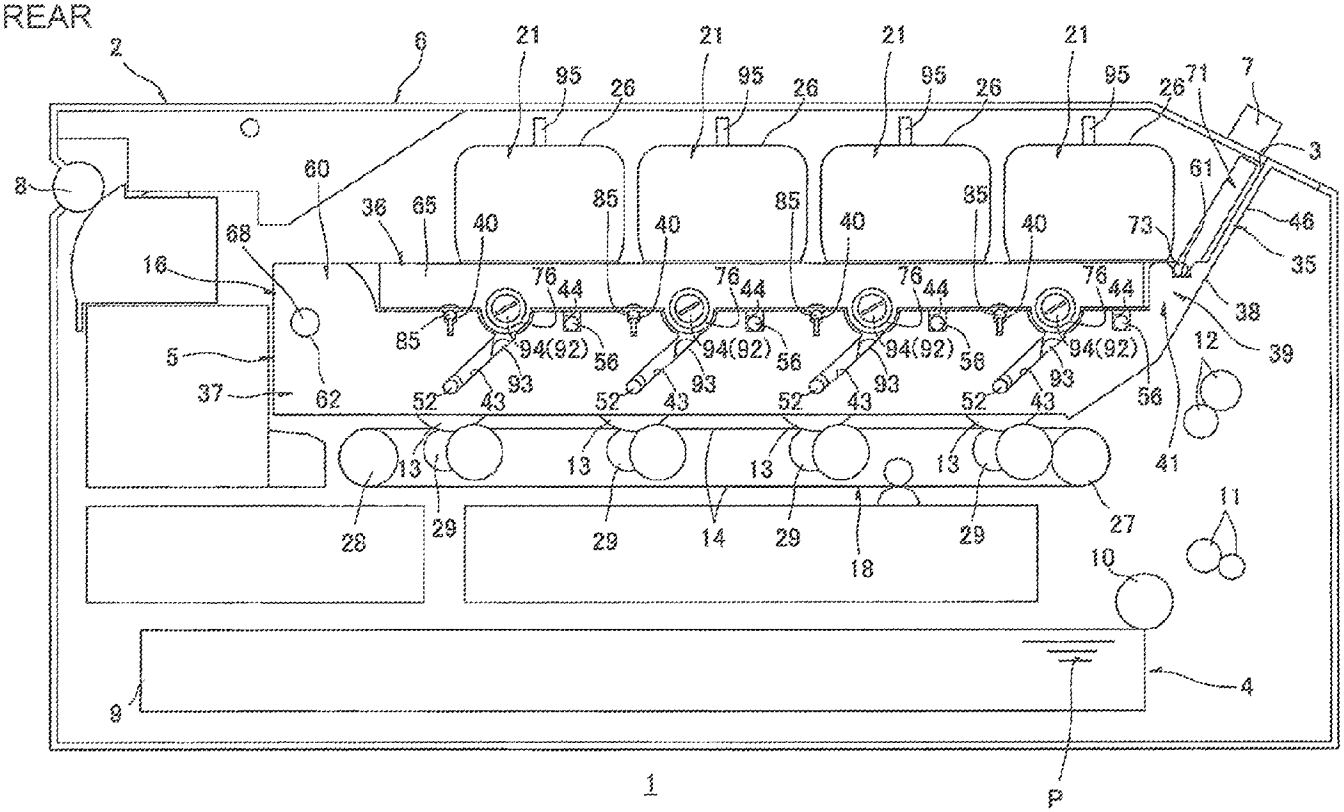
FIG. 3 is a left side view of the printer shown in FIG. 1, from which a left side wall of the casing is omitted.

As shown in FIG. 3, each of the drum guide grooves 43 formed in the left sidewall 39 has substantially an arc shape recessed downward from the upper end of the left sidewall 39 at an upper portion thereof, and is inclined rearward toward the bottom side at a lower portion thereof.

Each of the drum guide grooves 43 has a width substantially equal to an outside diameter of a corresponding one of the lower bosses 52, at the lower portion thereof.

As shown in FIG. 2, each of the LED positioning grooves 40 is formed at the rear of a corresponding one of the drum guide grooves 43 such that each of the LED positioning grooves 40 corresponds to one of positioning protrusions 85 of the LED units 17.

Each of the LED positioning grooves 40 is recessed downward from the upper end of the sidewall 39 at an upper portion thereof, and has substantially a U-shape. A lower portion of each LED positioning groove 40 continues from the upper portion thereof and is bent inward in the front-rear direction, and then extends downward.

Each of the sidewalls 39 includes a boss receiving portion 41 and a frame supporting portion 60.

The boss receiving portion 41 is formed corresponding to each end of a frame gripping portion 71 in the left-right direction, and is shaped in substantially a rectangle elongated upward from an upper end at a front side of the sidewall 39.

The boss receiving portion 41 has a boss receiving groove 61 at an upper end thereof. The boss receiving groove 61 is shaped like a letter U, in a side view, which is recessed downward from an upper end of the boss receiving portion 41. The upper end of the boss receiving portion 41 is shaped such that the boss receiving groove 61 gradually widens upward.

The frame supporting portion 60 is shaped in substantially a rectangle in a side view. The frame supporting portion 60 has a shaft insertion hole 62 having substantially a circular shape in a side view at a central portion of the frame supporting portion 60.

The front wall 38 is shaped such that it is inclined upward toward the front side along a lower end of the front end of each of the sidewall 39. The front wall 38 includes a fixing portion 46.

The fixing portion 46 continues from the upper end of the front wall 38, and is substantially L-shaped in a side view, which bends to the front side. A front end of the fixing portion 46 is fixed to a front wall of the casing 2.

Thus, the drum cartridge holding frame 37 is fixed immovably relative to the casing 2.

The developing cartridge holding frame 36 will be described.

Figure 6:
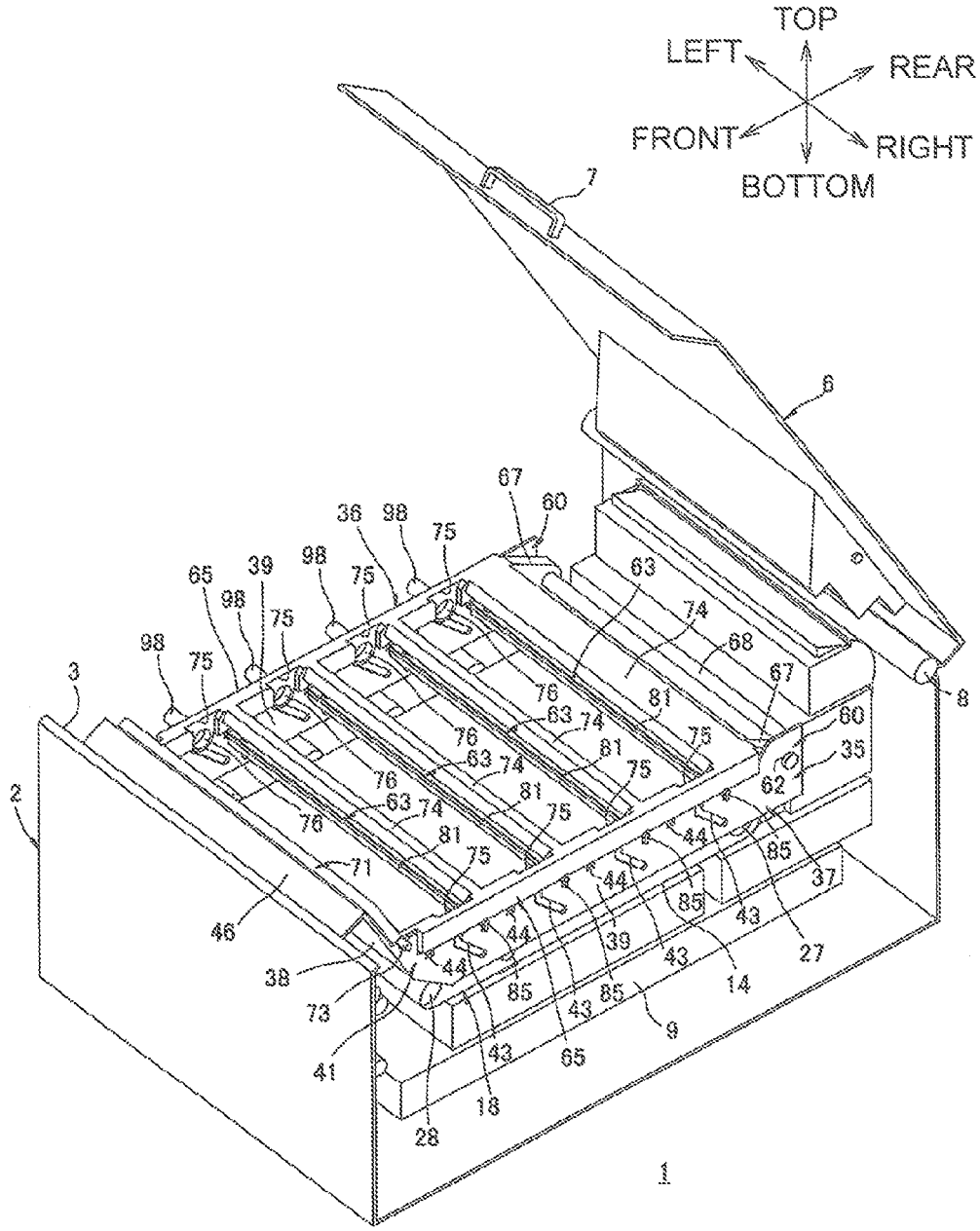
FIG. 6 is a perspective view of the printer shown in FIG. 1, from which developing cartridges and drum cartridges are removed.

As shown in FIG. 6, the developing cartridge holding frame 36 includes a pair of holding frame sidewalls 65 spaced apart from each other in the left-right direction, a frame gripping portion 71 extending between front ends of the holding frame sidewalls 65, and LED supporting portions 74 disposed between the holding frame sidewalls 65 and spaced in parallel relative to each other in the front-rear direction.

In the following description, the top, bottom, front, rear, left and right direction of the developing holding frame 36 are defined based on a case where the developing cartridge holding frame 36 is located in a light exposure position (FIGS. 1-6).

The holding frame sidewalls 65 extend in the front-rear direction.

As shown in FIG. 7, the frame gripping portion 71 is shaped like a flat plate elongated in the left-right direction, and has an opening 72 and engagement bosses 73.

The opening 72 is formed through the frame gripping portion 71 in a central portion thereof in the left-right direction and has substantially rectangular shape as viewed from the front side.

The engagement bosses 73 are shaped substantially cylindrically, and protrude outward from left and right end surfaces of the frame gripping portion 71 in a lower portion thereof.

As shown in FIG. 7, the lower end portions of the left and right ends of the frame gripping portion 71 are connected to the front end portions of the holding frame sidewalls 65. As shown in FIG. 1, the frame gripping portion 71 is inclined upward to the front side.

As shown in FIG. 6, the LED supporting portions 4 are shaped like a flat plate extending between the holding frame sidewalls 65. There are four LED supporting portions 4 spaced apart from each other at the rear of the frame gripping portion 71 in the front-rear direction.

As shown in FIG. 1, front and rear end surfaces of the LED supporting portions 74 are inclined along the toner storing portions 26 of the developing cartridges 21 when the developing cartridges 21 held by the developing cartridge holding frame 36 are projected in the left-right direction.

The LED units 17 are supported on lower surfaces of the respective LED supporting portions 74.

Each of the LED units 17 includes an LED array 80 and an LED frame 81 supporting the LED array 80.

The LED array 80 is disposed in a lower end portion of each LED unit 17. The LED array 80 is shaped like a flat plate extending in the left-right direction, and integrally holds a number of LEDs arranged in rows parallel to each other in the left and right direction.

The LED frame 81 is disposed on top of the LED array 80. The LED frame 81 is shaped in substantially a rectangle in a side view (FIG. 4), and is elongated in the left-right direction.

The LED frame 81 includes a plurality of, e.g., two, positioning protrusions 85 (FIGS. 2 and 3), and a plurality of, e.g., two, compression springs 83.

As shown in FIG. 7, each of the positioning protrusions 85 is disposed on one of left and right end surfaces of the LED frame 81. An upper part of each positioning protrusion 85 is shaped like a cylinder extending outward from one of the left and right end surfaces of the LED frame 81, while a lower part of each positioning protrusions 85 is shaped in substantially a rectangle, as viewed from a left or right side, protruding downward from a lower end of the upper part of each positioning protrusion 85 (FIG. 2).

As shown in FIG. 1, each compression spring 83 is wound in an air-cored coil form and disposed on one of left and right end portion of the LED frame 81 on an upper surface of the LED frame 81.

The compression spring 83 is fixed at its lower end portion to the upper surface of the LED frame 81 and at its upper end portion to a lower surface of the LED supporting portion 74.

Thus, the LED unit 17 is supported by the LED supporting portion 74 such that the LED array 80 is movable in the top-bottom direction. The LED frame 81 is urged downward by the compression spring 83 under normal conditions.

As shown in FIG. 6, the developing cartridge holding frame 36 has a plurality of, e.g., four, receiving openings 63 partitioned by the pair of holding frame sidewalls 65, the frame gripping portion 71 and the four LED supporting portions 74.

Specifically, the frontmost receiving opening 63 is defined by a rear end portion of the frame gripping portion 71, the frontmost LED supporting portion 74 and the pair of holding frame sidewalls 65.

The other three receiving openings 63 (except for the frontmost receiving opening 63) are defined by two adjacent LED supporting portions 74 and the pair of holding frame sidewall 65.

Each of the receiving openings 63 is shaped in substantially a rectangle as viewed from the top side. Recessed portions 75 are formed at left and right sides of the receiving opening 63.

The recessed portions 75 are shaped like a letter U, as viewed from the left and right sides, and recessed outward from inner surfaces of the holding frame side walls 65 in the left-right direction.

The left holding frame sidewall 65 has coupling insertion portions 76 corresponding to the receiving openings 63. As shown in FIG. 3, the coupling insertion portions 76 are formed through the left holding frame sidewall 65 and have a circular shape.

Figure 5:
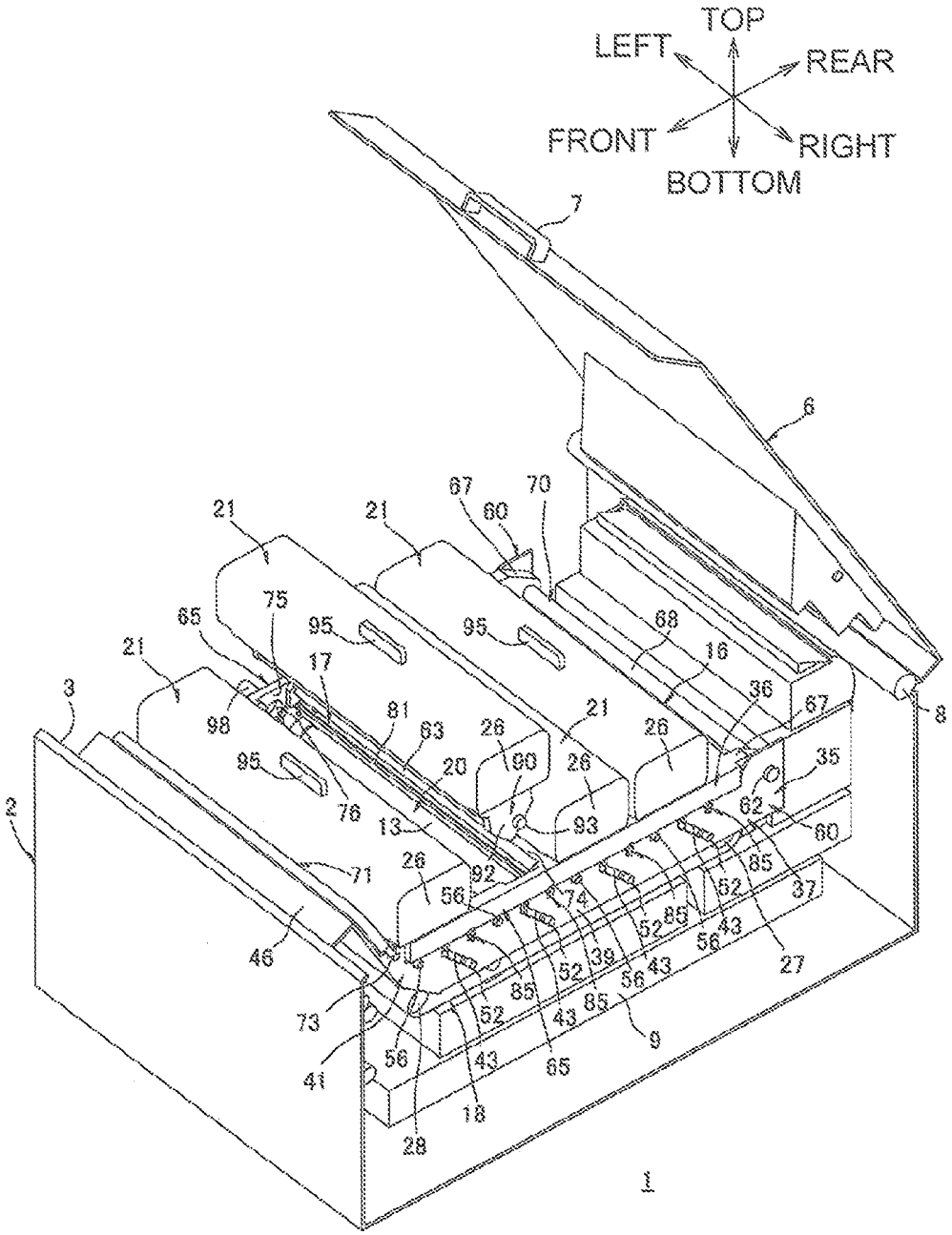
FIG. 5 is a perspective view of the printer shown in FIG. 1, in which the top cover is located in the open position.

As shown in FIG. 5, the developing cartridge holding frame 36 includes a rotating portion 70.

The rotating portion 70 is disposed in a rear end portion of the developing cartridge holding frame 36, and includes rotation shaft holding portions 67 and a rotation shaft 68.

The rotation shaft holding portions 67 are shaped in substantially a flat plate which continues from left and right ends of the rear end of the rearmost LED supporting portion 74, respectively, and protrudes downward to the rear side (FIG. 1).

The rotation shaft 68 is shaped in a cylinder extending in the left-right direction, and left and right end portions of the rotation shaft 68 are supported by the rotation shaft holding portions 67 so as not to rotate relative to the rotation shaft holding portions 67. Thus, the rotation shaft 68 does not rotate relative to the developing cartridge holding frame 36. The left and right end portions of the rotation shaft 68 protrude outward from the respective rotation shaft holding portions 67 in the left-right direction. The rotation shaft 68 has a length in the left-right direction longer than a distance between the frame holding portions 60 spaced apart from each other in the left-right direction.

The left and right end portions of the rotation shaft 68 are inserted into shaft insertion holes 62 formed in the respective frame supporting portion 60 of the drum cartridge holding frame 37, thereby the developing cartridge holding frame 36 is supported by the drum cartridge holding frame 37 (or the casing 2) so as to move relative thereto.

Specifically, the developing cartridge holding frame 36 is configured to pivot about the rotation shaft 68 between a light exposure position (FIG. 1) where the LED arrays 80 are located in a location close to the respective photosensitive drums 13 and a separation position (FIG. 7) where the LED arrays 80 are separated from the respective photosensitive drums 13.

As shown in FIG. 1, when the developing cartridge holding frame 36 is located in the light exposure position, the LED arrays 80 of the LED units 17 are disposed facing the respective photosensitive drums 13 from above.

As shown in FIGS. 2 and 3, the positioning protrusions 85 of the LED units 17 are disposed in the respective LED positioning grooves 40. This prevents movement of the LED units 17 in the front-rear direction relative to the drum cartridge holding frame 37.

The engagement bosses 73 are received in the boss receiving grooves 61 of the drum cartridge holding frame 37, and the lower end portions of the holding frame sidewalls 65 are disposed facing the upper ends of the sidewalls 39 with a slight distance.

The casing 2 includes couplings 98. As shown in FIG. 6, the couplings 98 are disposed such that, when the developing cartridge holding frame 36 is located in the light exposure position, the couplings 98 are spaced apart from and face the respective coupling insertion portions 76 in the left-right direction. The couplings 98 are shaped in substantially a cylinder, and configured to move in the left-right direction.

As shown in FIG. 7, when the developing cartridge holding frame 36 is located in the separation position, the LED arrays 80 of the LED units 17 are separated from the respective photosensitive drums 13, and the LED positioning protrusions 85 are disengaged from the respective LED positioning grooves 40. The engagement bosses 73 are also disengaged from the respective boss receiving grooves 61.

The drum cartridge holding frame 37 holds the drum cartridges 20 detachably.

Each of the drum cartridges 20 includes a drum frame 47.

Figure 4:
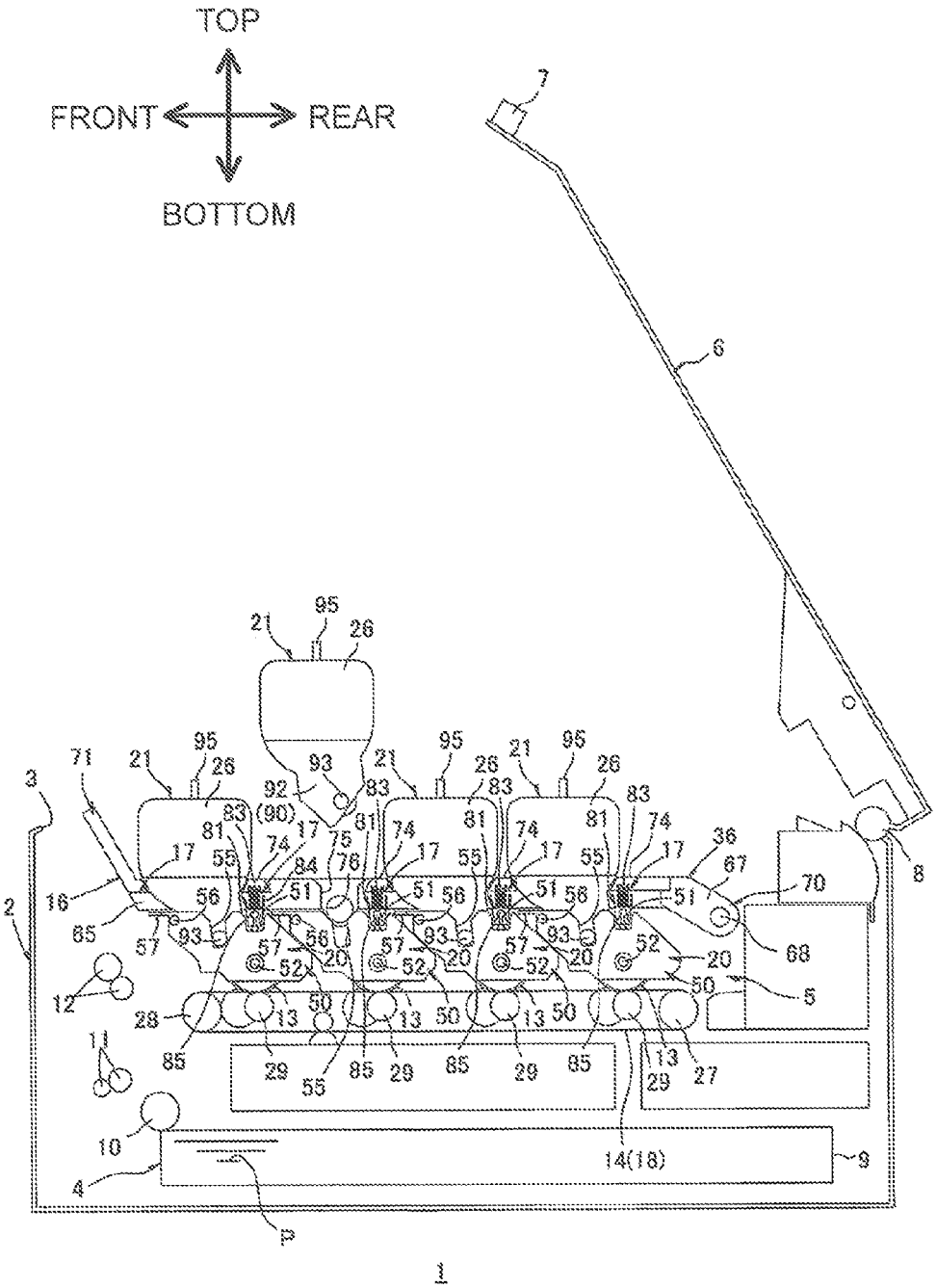
FIG. 4 is a side sectional view of the printer shown in FIG. 1, in which a top cover is located in an open position.

The drum frame 47 is shaped like a box of which lower portion is open (FIG. 1). As shown in FIGS. 4 and 7, the drum frame 47 includes a pair of drum sidewalls 50 spaced apart from each other in the left-right direction and a drum front wall 54 connecting front portions of the drum sidewalls 50.

Each of the drum sidewalls 50 is shaped in substantially a flat plate, and includes a LED receiving groove 51, a boss guide groove 55, a lower boss 52, and an upper boss 56, which are located in the same positions.

The LED receiving groove 51 is shaped like a letter U, in a side view, which is recessed downward from an upper end of the drum sidewall 50.

The boss guide groove 55 is disposed at the front of the LED receiving groove 51 and is shaped like a letter U, in a side view, which is recessed downward from the upper end of the drum sidewall 50. The boss guide groove 55 widens upward.

The lower boss 52 is disposed under the LED receiving groove 51 and shaped like a cylinder protruding outward in the left-right direction from an outer surface of the drum sidewall 50 (FIG. 4).

The upper boss 56 is disposed in a front end of the drum side wall 50 and is shaped like a cylinder protruding outward in the left-right direction from the outer surface of the drum sidewall 50 (FIG. 4).

As shown in FIG. 7, the drum front wall 54 is shaped in substantially a flat plate, which extends between the front end portions of the drum sidewalls 50 and is elongated in the left-right direction.

The drum front wall 54 integrally includes a drum gripping portion 57.

The drum gripping portion 57 is shaped in a rectangle as viewed from the top side, which continues from a central portion of the upper end portion of the drum front wall 54 in the left-right direction and extends to the front side.

The drum cartridges 20 are held in the drum cartridge holding frame 37 such that the lower bosses 52 are disposed in lower ends of the respective drum guide grooves 43 and the upper bosses 56 are located in the respective drum positioning grooves 44 as shown in FIGS. 2 and 3.

As shown in FIG. 5, the developing cartridges 21 are detachably attached to the developing cartridge holding frame 36.

Each of the developing cartridges 21 integrally includes a developing portion 90 and a toner storing portion 26 disposed on top of the developing portion 90.

The developing portion 90 extends in the left-right direction, and is open toward the rear side (FIG. 1). Left and right ends of the developing portion 90 are closed by a pair of developing sidewalls 92.

As shown in FIG. 4, each of the developing sidewalls 92 is shaped in substantially a triangle narrowing downward in a side view, and a boss 93 is disposed in a rear part of the sidewall 92.

As shown in FIG. 5, the boss 93 is shaped like a cylinder protruding outward in the left-right direction from an outer surface of the developing sidewall 92.

As shown in FIG. 3, the left developing sidewall 92 of each developing cartridge 21 includes a drive input portion 94.

As shown in FIG. 1, each developing portion 90 accommodates the developing roller 23, the supply roller 24, and the layer-thickness regulating blade 25, and a rear part of the developing roller 23 is exposed outside from the developing portion 90.

Each drive input portion 94 is configured to transmit a drive force to the developing roller 23 and the supply roller 24 via the coupling 98 when the drive force from the casing 2 is input.

As shown in FIG. 5, each of the toner storing portions 26 is substantially box-shaped to have the form of substantially a rectangle in a side view, and communicates with the developing portion 90 at a lower end thereof (FIG. 1).

The toner storing portion 26 includes a cartridge gripping portion 95.

The cartridge gripping portion 95 is shaped in substantially a flat plate that continues from the toner storing portion 26 and protrudes upward from a central portion in the left-right direction at an upper end of the toner storing portion 26.

The toner storing portions 26 have a dimension in the front-rear direction longer than that of the respective receiving openings 63 (FIG. 6), and a dimension in the left-right direction longer than that of the respective receiving openings 63 (FIG. 6).

As shown in FIG. 1, the toner storing portions 26 store black, yellow, magenta, and cyan toners, respectively.

As shown in FIG. 4, the developing cartridges 21 are attached to the developing cartridge holding frame 36 such that the bosses 93 are fitted in the boss guide grooves 55 of the drum sidewalls 50 and the lower ends of the toner storing portions 26 are supported by peripheral portions of the receiving openings 63 (LED supporting portions 74 and the holding frame sidewalls 65).

As shown in FIG. 3, the drive input portions 94 of the left developing sidewall 92 are exposed outside from the left holding frame sidewall 65 through the respective coupling insertion portions 76. The drive input portions 94 are coupled to the respective couplings 98 when the developing cartridges 21 are attached to the developing cartridge holding frame 36 and the developing cartridge holding frame 36 is located in the light exposure position.

As shown in FIG. 1, the toner storing portions 26 of the developing cartridges 21 are disposed such as to overlap the LED units 17 as viewed from the top side when the developing cartridges 21, attached to the developing cartridge holding frame 36 located in the light exposure position, are projected in the top-bottom direction (or in a direction where the developing cartridges 21 are attached or removed).

Next, the following will describe attachment and removal of the developing cartridges 21 relative to the casing 2.

As shown in FIGS. 4 and 5, in a case where a developing cartridge 21 is removed from the casing 2, the handle 7 of the top cover 6 is held and raised, and the top cover 6 is located in the open position such that the opening 3 is open.

The cartridge gripping portion 95 of the developing cartridge 21 is held and raised to pull the developing cartridge 21 upward.

The bosses 93 of the developing cartridge 21 are guided through the boss guide grooves 55, and the developing cartridge 21 is removed from the developing cartridge holding frame 36 along the top-bottom direction.

When the developing cartridge 21 is moved further upward, the developing cartridge 21 is removed from the casing 2 through the opening 3.

In a case where the developing cartridge 21 is attached to the casing 2, the above removal procedure is reversed.

In other words, the developing cartridges 21 are detachably attachable to the developing cartridge holding frame 36 via the opening 3 when the developing cartridge holding frame 36 is located in the light exposure position.

Next, the following will describe attachment and removal of the drum cartridges 20 relative to the casing 2.

As shown in FIG. 7, in a case where a drum cartridge 20 is removed from the casing 2, the top cover 6 is located in the open position, the frame gripping portion 71 of the drum cartridge 20 is held and raised such that the developing cartridge holding frame 36 holding the four developing cartridges 21 is pivoted from the light exposure position to the separation position.

The drum gripping portion 57 of the drum cartridge 20 is held and raised to pull the drum cartridge 20 upward.

The lower boss 52 of the drum frame 47 is guided through the lower portion of the drum guide groove 43, and the drum cartridge 20 is moved to the upper front side.

When the lower boss 52 reaches the upper part of the drum guide groove 43, the lower boss 52 is guided through the upper part of the drum guide groove 43, and the drum cartridge 20 is moved upward.

Thus, the drum frame 47 is pulled upward from the drum cartridge holding frame 37.

When the drum cartridge 20 is moved further upward, the drum cartridge 20 is removed from the casing 2 through the opening 3.

In a case where the drum cartridge 20 is attached to the casing 2, the above removal procedure is reversed.

Thus, the photosensitive drum 13 supported by the drum cartridge 20 is detachably attachable relative to the casing 2.

As shown in FIGS. 5 and 7, the printer 1 is configured such that the developing cartridge holding frame 36 holding the four developing cartridges 21 is movable between the light exposure position and the separation position. As shown in FIG. 5, with the developing cartridge holding frame 36 in the light exposure position, the developing cartridges 21, of which replacement is required with higher frequency than the photosensitive drums 13, can be detachably attached relative to the casing 2 in complete isolation.

As shown in FIG. 7, with the developing cartridge holding frame 36 in the separation position, the LED units 17 can be separated from the photosensitive drums 13 and the developing cartridges 21 can be also separated from the photosensitive drums 13.

In other words, only by locating the developing cartridge holding frame 36 in the separation position, both of the LED units 17 and the developing cartridges 21 can be separated from the photosensitive drums 13.

Thus, only by locating the developing cartridge holding frame 36 in the separation position, the photosensitive drums 13 can be removed from the casing 2 without having to remove the developing cartridges 21 from the casing 2 in advance, which improves the efficiency of replacing the photosensitive drums 13.

Thus, the developing cartridges 21 and the photosensitive drums 13 can be detachably attached relative to the casing 2 in complete isolation, which facilitates maintenance of the photosensitive drums 13.

As shown in FIG. 5, when the top cover 6 is located in the open position and the developing cartridge holding frame 36 is located in the light exposure position, the developing cartridges 21 are detachably attachable to the developing cartridge holding frame 36 through the opening 3.

Thus, the developing cartridge 21 can be detachably attached relative to the casing 2 with reliability.

This facilitates maintenance of the developing cartridges 21.

The developing cartridge holding frame 36 is configured to pivot about the rotation shaft 68 disposed at the rear end of the developing cartridge holding frame 36 between the light exposure position and the separation position.

Thus, the developing cartridge holding frame 36 can be moved between the light exposure position and the separation position.

As shown in FIG. 1, there are four photosensitive drums 13 each corresponding to one color of black, yellow, magenta, and cyan, and there are four developing cartridges 21 each corresponding to one of the photosensitive drums 13.

Each of the toner storing portions 26 of the developing cartridges 21 stores a toner of one color of black, yellow, magenta, and cyan. Thus, a full-color image can be formed.

As shown in FIG. 4, the developing cartridges 21 are detachably attachable relative to the casing 2, with the developing cartridge holding frame 36 remaining in the light exposure or with the LED units 17 remaining located proximate to the respective photosensitive drums 13 (FIG. 1).

Thus, there is no need to leave a space for moving the LED units 17 between adjacent toner storing portions 26.

As a result, the physical size of the toner storing portions 26 can be increased, and thus the amount of toner stored in the toner storing portions 26 can be increased.

As shown in FIG. 1, the toner storing portions 26 of the developing cartridges 21 are disposed such as to overlap the LED units 17 as viewed from the top side when the developing cartridges 21, attached to the developing cartridge holding frame 36 located in the light exposure position, are projected in the top-bottom direction (or in a direction where the developing cartridges 21 are attached or removed).

As the physical size of the toner storing portions 26 can be increased, the amount of toner stored in the toner storing portions 26 can be increased.

A second embodiment will be described with reference of FIGS. 8 and 9.

Figure 8:
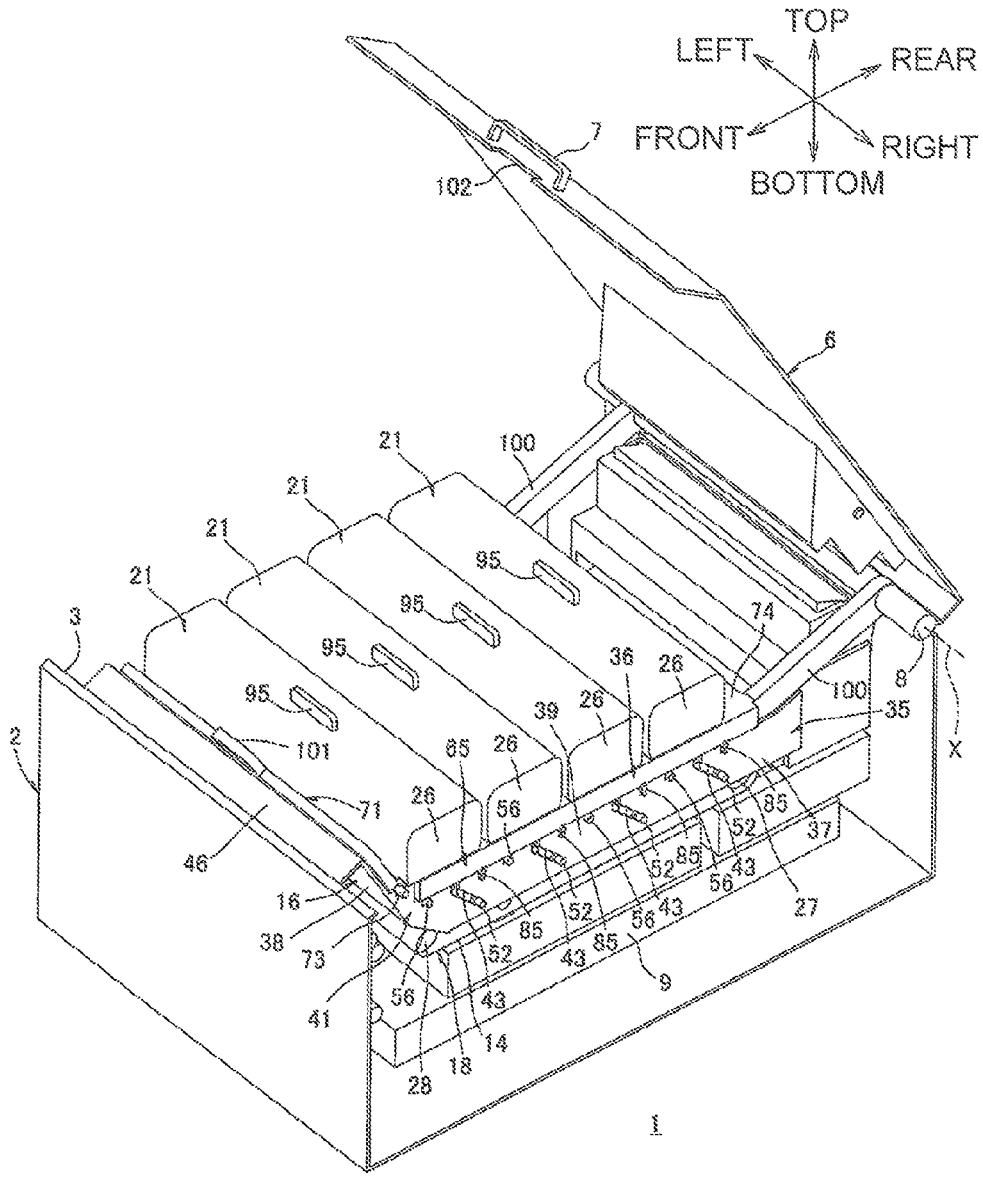
FIG. 8 is a perspective view of a printer according to a second illustrative embodiment, in which a top cover is located in an open position.
Figure 9:
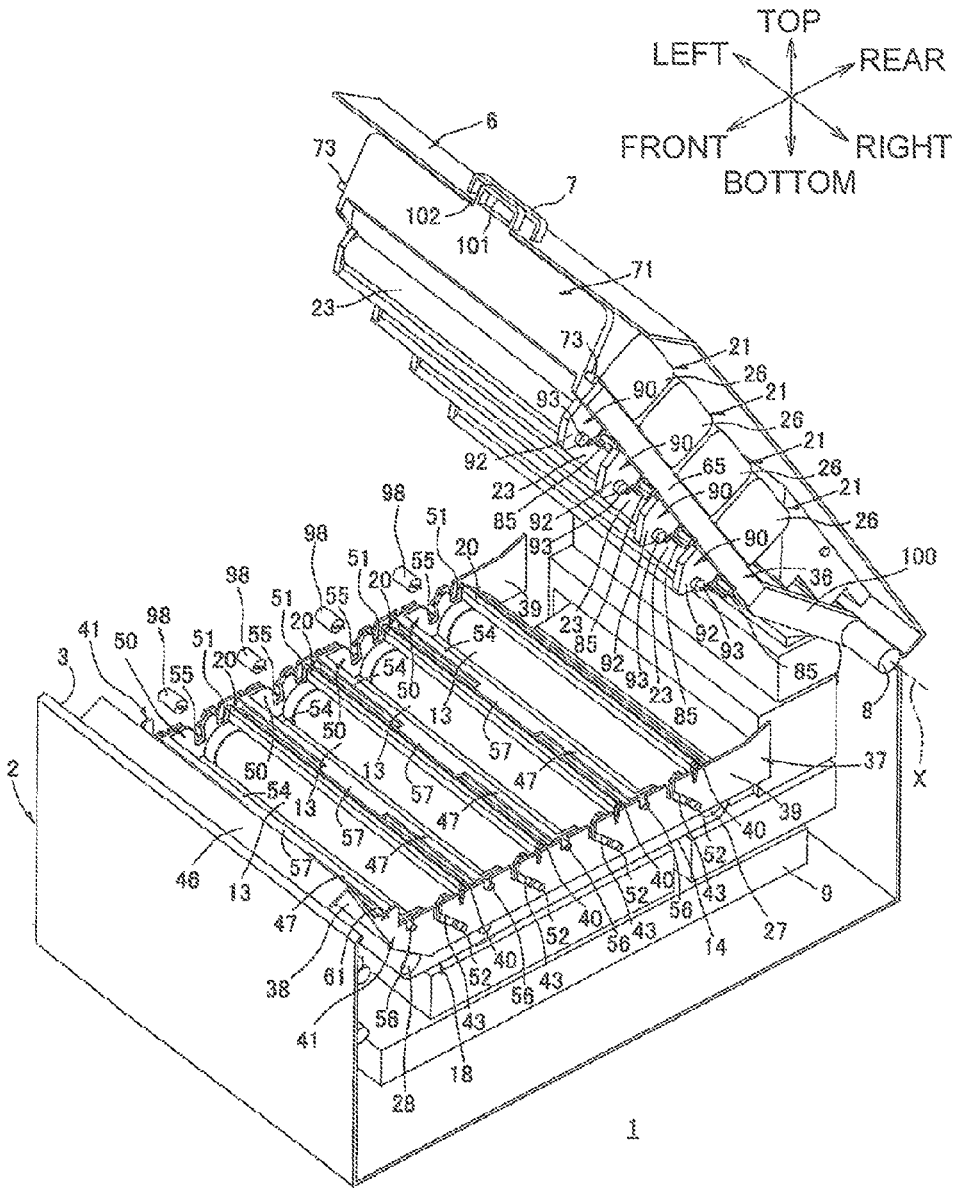
FIG. 9 is a perspective view of the printer shown in FIG. 8, in which a developing cartridge holding frame is located in an upper position.

It is noted that, in FIGS. 8 and 9, elements similar to or identical with those shown and described with FIGS. 1-7 are designated by similar numerals, and thus the description thereof can be omitted for the sake of brevity.

The first embodiment shows that the developing cartridge holding frame 36 includes the rotating portion 70 and is configured to pivot about the rotation shaft 68 as shown in FIG. 5.

As shown in FIG. 8, the second embodiment shows that the developing cartridge holding frame 36 includes arm portions 100 each coupling the developing cartridge holding frame 36 and the hinge portion 8 of the top cover 6. The developing cartridge holding frame 36 is configured to pivot about the hinge portion 8.

The arm portions 100 are shaped in substantially a flat plate continuing from left and right ends of the rearmost LED supporting portion 74 (FIG. 6) and extending diagonally upward toward the rear side.

Rear ends of the arm portions 100 are rotatably coupled to the hinge portion 8 of the top cover 6.

Thus, the developing cartridge holding frame 36 is configured to pivot about the hinge portion 8 between the light exposure position (FIG. 8) and the separation position (FIG. 9). In other words, the top cover 6 and the developing cartridge holding frame 36 share a rotation axis X.

The top cover 6 has a notched portion 102. The notched portion 102 is shaped like a letter U, as viewed from the top side, which is recessed rearward from a central portion of the front end of the top cover 6 in the left-right direction.

The frame gripping portion 71 includes a handle 101 corresponding to the notched portion 102 of the top cover 6.

The handle 101 is shaped like a letter U, which is open downward, as viewed from the front side, and is fixed to the frame gripping portion 71 so as to straddle a central portion of the upper end of the frame gripping portion 71.

The handle 101 protrudes upward from the notched portion 102 of the top cover 6 when the top cover 6 is in the closed position.

When the handle 101 is held and raised such that the developing cartridge holding frame 36 is pivoted from the light exposure position to the separation position, as shown in FIG. 9, the top cover 6 is pressed upward by the upper end of the gripping portion 71 and pivoted, along with the developing cartridge holding frame 36, from the closed position to the open position.

In other words, along with pivoting of the developing cartridge holding frame 36 from the light exposure position to the separation position, the top cover 6 is pivoted integrally with the developing cartridge holding frame 36, from the closed position to the open position.

Thus, without having to move the top cover 6 and the developing cartridge holding frame 36 separately, the top cover 6 and the developing cartridge holding frame 36 can be simultaneously moved to the open position and the separation position, respectively.

Thus, this facilitates maintenance of the photosensitive drums 13.

Even with the second embodiment, it is clear that effects similar to those brought about by the first embodiment can be appreciated.

A third embodiment will be described with reference to FIGS. 10-12.

Figure 10:
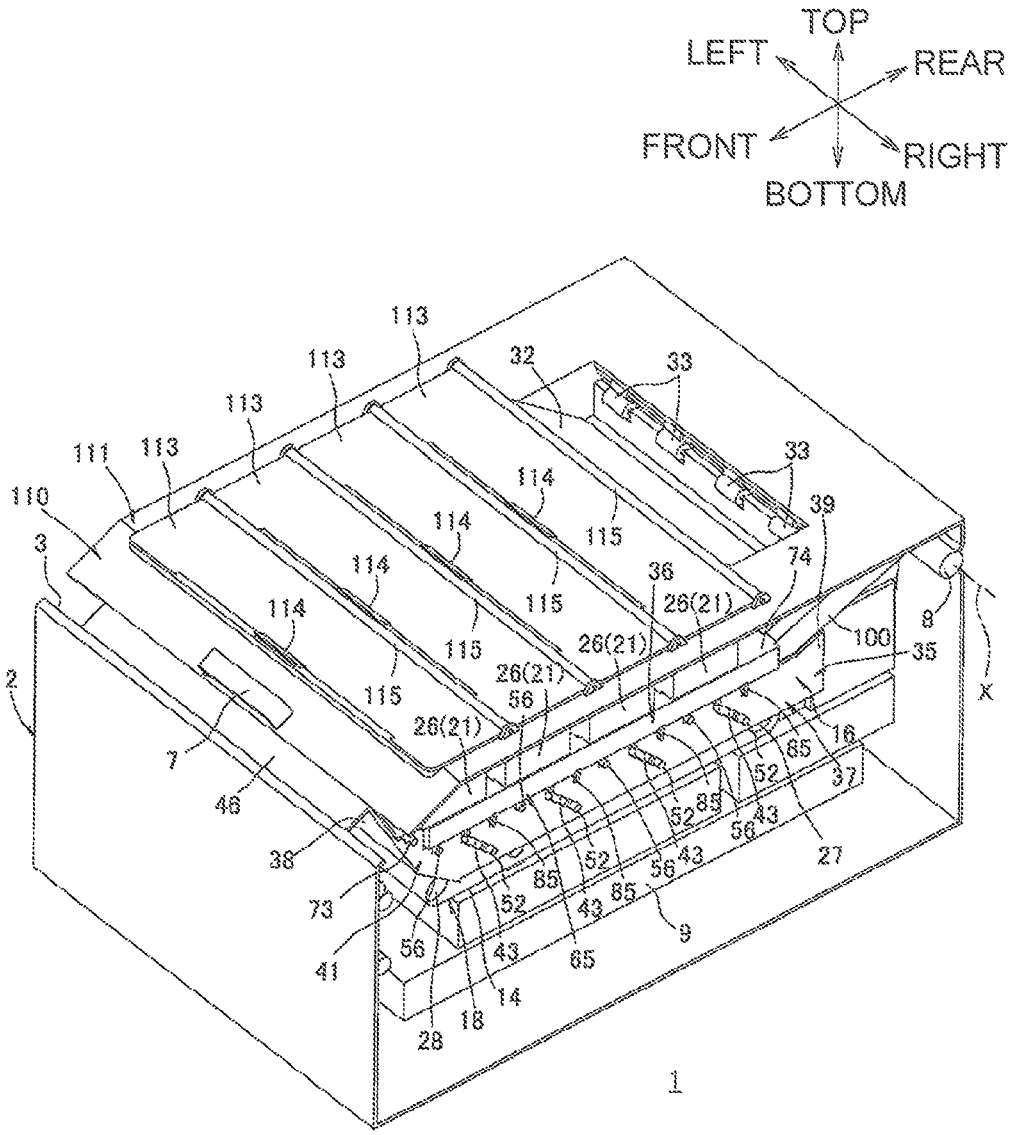
FIG. 10 is a perspective view of a printer according to a third illustrative embodiment, from which a right side wall of a casing is omitted.
Figure 11:
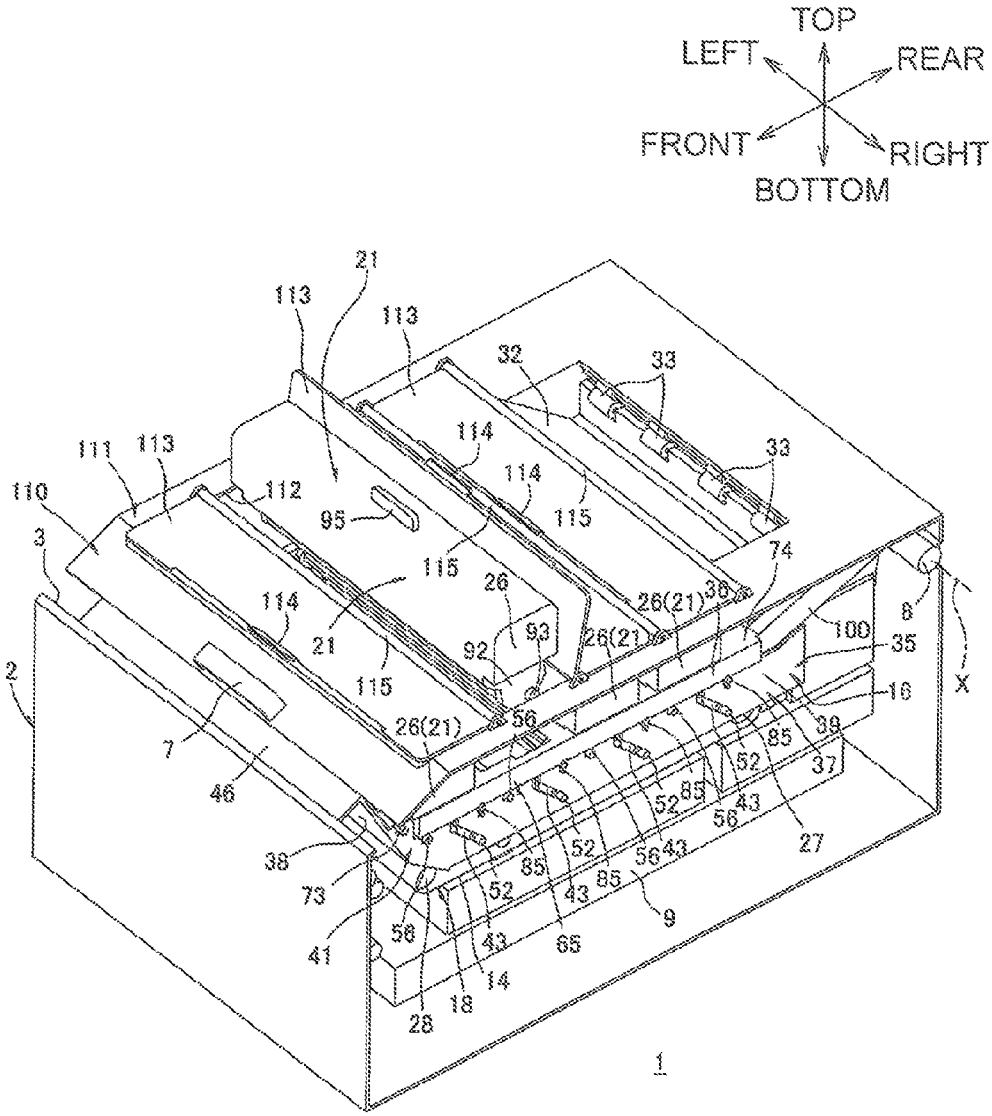
FIG. 11 is a perspective view of the printer shown in FIG. 10, in which an opening cover is located in an open position.
Figure 12:
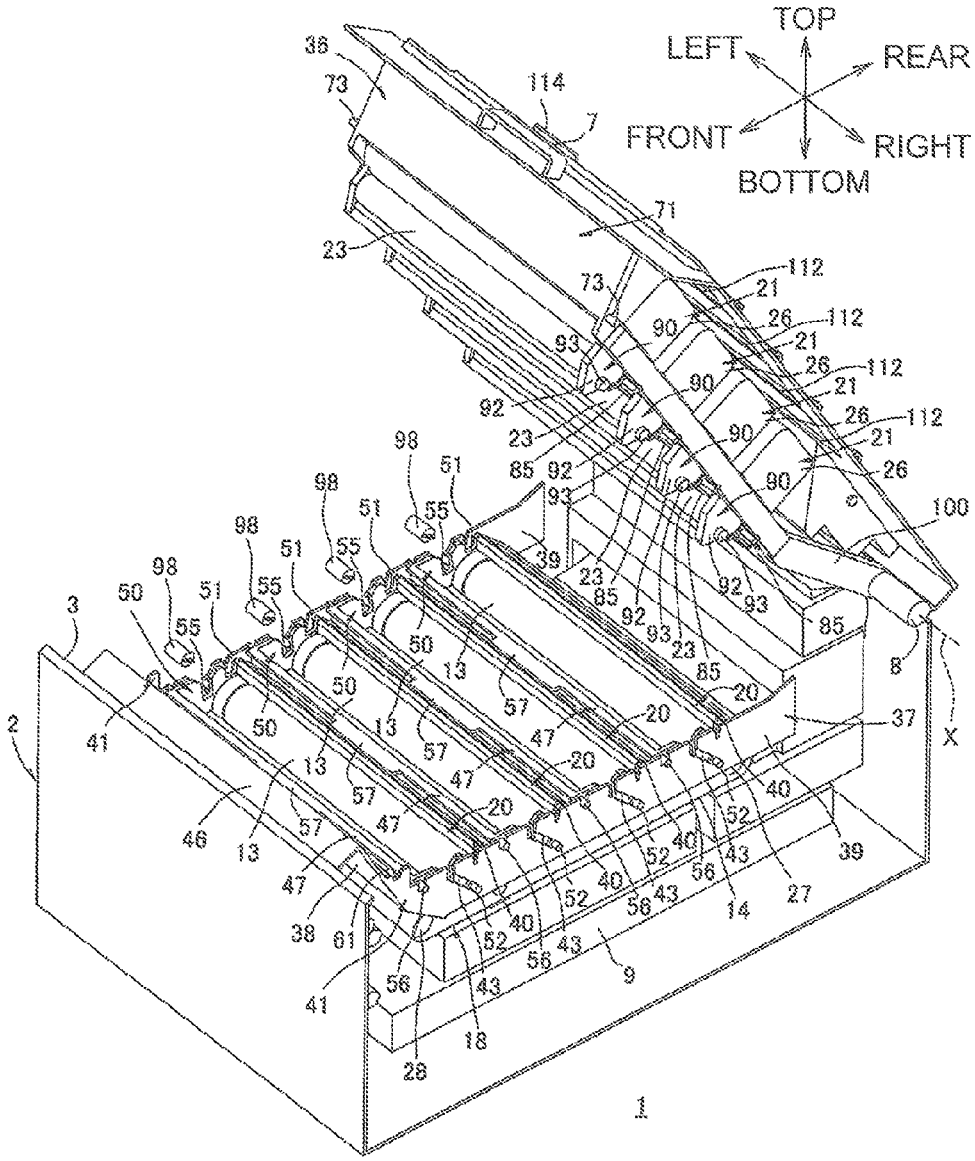
FIG. 12 is a perspective view of the printer shown in FIG. 10, in which a supporting member is located in an upper position.

It is noted that, in FIGS. 10-12, elements similar to or identical with those shown and described with FIGS. 1-9 are designated by similar numerals, and thus the description thereof can be omitted for the sake of brevity.

The second embodiment shows that, as shown in FIG. 8, the top cover 6 and the developing cartridge holding frame 36 are prepared separately. The third embodiment shows that the top cover 6 and the developing cartridge holding frame 36 are provided as a single part as shown in FIG. 12.

Specifically, the upper end of the frame gripping potion 71 of the developing cartridge holding frame 36 is fixed to a lower surface of the front end of the top cover 6, and the rear ends of the arm portions 100 of the developing cartridge holding frame 36 are coupled to the hinge portion 8 of the top cover 6.

With this structure, the top cover 6 and the developing cartridge holding frame 36 are integrally formed as a supporting member 110. The supporting member 110 is configured to pivot about the hinge portion 8 between the light exposure position (FIG. 10) and the separation position (FIG. 12). An upper wall of the supporting member 110 (corresponding to the top cover 6 of the first and second embodiments) is formed as an upper supporting wall 111.

The upper supporting wall 111 has a plurality of, e.g., four, supporting member openings 112, as an example of an opening.

As shown in FIG. 11, the supporting member openings 112 are formed through the upper support wall 111, in the shape of substantially a rectangle as viewed from the top side, and are spaced in parallel relative to each other in the front-rear direction.

The upper support wall 111 includes a plurality of, e.g., four, covers 113 corresponding to the supporting member openings 112.

Each of the covers 113 is shaped in substantially a flat rectangular plate, and includes a cover gripping portion 114 at a front end thereof and a hinge 115 at a rear end thereof.

The cover gripping portion 114 is shaped in substantially a flat plate, and protrudes upward from a central portion of the front end of the cover 113 in the left-right direction.

Each cover 113 is configured to pivot about the hinge 115, which is fixed to an upper surface of the upper support wall 111, between an open position (FIG. 11) where the support member opening 112 is open and a closed position where the support member opening 112 is closed (FIG. 10).

In the third embodiment, when a developing cartridge 21 to be replaced is removed from the casing 2, as shown in FIG. 11, the cover gripping portion 114 of the cover 113, which corresponds to the developing cartridge 21 to be replaced, is held and the cover 113 is moved to the open position such that the support member opening 112 is open.

Then, the cartridge gripping portion 95 of the developing cartridge 21 is held and raised to pull the developing cartridge 21 upward.

The developing cartridge 21 is pulled upward from the developing cartridge holding frame 36 of the supporting member 110, and removed from the casing 2 through the support member opening 112.

To attach a developing cartridge 21 to the casing 2, the above removal procedure is reversed.

In other words, the developing cartridges 21 are detachably attachable to the developing cartridge holding frame 36 of the supporting member 110 via the respective support member openings 112 in a state that the supporting member 110 is located in the light exposure position.

Thus, even with the third embodiment, it is clear that effects similar to those brought about by the first embodiment can be appreciated.

Only one of the developing cartridges 21, which needs replacing, can be removed and replaced relative to the developing cartridge holding frame 36 of the supporting member 110 via a corresponding one of the support member openings 212. Thus, this structure facilitates maintenance of the developing cartridges 21.

When a drum cartridge 20 is removed from the casing 2, as shown in FIG. 12, the handle 7 of the supporting member 110 is held and raised such that the supporting member 110 is located in the separation position such that the opening 3 is open.

Thus, with the same removal procedure described in the first embodiment, the drum cartridges 20 can be removed from the casing 2 via the opening 3.

The first, second, and third embodiments can be combined as appropriate.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a main body having an opening in an upper portion of the main body;

at least one photosensitive drum detachably attached to the main body through the opening of the main body;

at least one LED unit disposed above the at least one photosensitive drum, the at least one LED unit including a LED array configured to expose the at least one photosensitive drum to light, a frame supporting the LED array at a lower surface, and at least one spring attached to an upper surface of the frame;

at least one developer container disposed above the at least one photosensitive drum and configured to store a developer to be supplied to the at least one photosensitive drum; and a supporting member disposed in the main body and having an upper surface and a lower surface, the supporting member supporting the at least one LED unit at the lower surface and being configured to hold the at least one developer container detachably at the upper surface, the supporting member being configured to, while holding the at least one developer container at the upper surface, pivot about an axis between a light exposure position where the LED array of the at least one LED unit is located proximate to the at least one photosensitive drum and a separation position where the LED array of the at least one LED unit is separated from the at least one photosensitive drum while the supporting member holds the at least one developer container at the upper surface.

2. The image forming apparatus according to claim 1, wherein the spring of the at least one LED unit is attached to the lower surface of the supporting member.

3. The image forming apparatus according to claim 1, further comprising a top cover disposed above the opening of the main body and configured to pivot between an open position and a closed position, wherein, when the top cover is at the open position, the at least one developer container held by the supporting member is exposed to outside through the opening of the main body.

4. The image forming apparatus according to claim 1, further comprising a top cover disposed above the opening of the main body and configured to pivot between an open position and a closed position, wherein the top cover is configured to pivot about the axis which the supporting member pivots.

5. The image forming apparatus according to claim 1, further comprising a top cover disposed above the opening of the main body and configured to pivot between an open position and a closed position, wherein, when the top cover is in the open position and the supporting member is in the separation position, the at least one photosensitive drum is detachable from the main body through the opening of the main body.

6. The image forming apparatus according to claim 1, further comprising a top cover disposed above the opening of the main body and configured to pivot between an open position and a closed position, wherein the at least one developer container is configured to, when the top cover is at the open position, be attachable to and removable from the supporting member through the opening of the main body.

7. The image forming apparatus according to claim 1, wherein the supporting member includes at least one receiving opening for receiving the at least one developer container.

8. The image forming apparatus according to claim 1, wherein the at least one photosensitive drum comprises a plurality of photosensitive drums, wherein the at least one LED unit comprises a plurality of LED units equal in number to the number of the photosensitive drums, and wherein the at least one developer container comprises a plurality of developer containers equal in number to the number of the photosensitive drums.

* * * * *